US009826320B2

(12) United States Patent
Gudiksen

(10) Patent No.: US 9,826,320 B2
(45) Date of Patent: Nov. 21, 2017

(54) HEARING DEVICE AND A METHOD FOR RECEIVING WIRELESS AUDIO STREAMING

(71) Applicant: GN Hearing A/S, Ballerup (DK)

(72) Inventor: Ole Gudiksen, Farum (DK)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 13/899,329

(22) Filed: May 21, 2013

(65) Prior Publication Data

US 2014/0341406 A1 Nov. 20, 2014

(30) Foreign Application Priority Data

May 15, 2013 (DK) ..... 2013 70264
May 15, 2013 (EP) ..... 13167810

(51) Int. Cl.
*H04R 25/00* (2006.01)

(52) U.S. Cl.
CPC ..... *H04R 25/554* (2013.01); *H04R 25/43* (2013.01); *H04R 2225/55* (2013.01)

(58) Field of Classification Search
CPC ..... H04W 36/00–36/365; H04R 25/554
USPC ..... 455/434, 464, 103, 179.1, 62, 436, 437
See application file for complete search history.

(56) References Cited

U.S. PATENT DOCUMENTS 4,694,495 A * 9/1987 Schroeer ..... 381/15
6,278,877 B1 8/2001 Brederveld et al.
6,804,510 B1 * 10/2004 Bates ..... H04H 20/24 455/154.1
7,110,765 B2 9/2006 Amerga et al.
7,454,683 B2 11/2008 Vesma et al.
8,631,143 B2 * 1/2014 Simonds ..... H04N 21/21805 709/225
2002/0132585 A1 9/2002 Palermo et al.
2003/0055995 A1 * 3/2003 Ala-Honkola ... H04N 21/23406 709/231
2004/0001602 A1 * 1/2004 Moo et al. ..... 381/315
2004/0081125 A1 4/2004 Ranta-Aho et al.
2006/0168638 A1 * 7/2006 Yang ..... 725/131
(Continued)

FOREIGN PATENT DOCUMENTS

CN 1729629 A 2/2006
CN 101141335 A 3/2008
(Continued)

OTHER PUBLICATIONS

English translation of JP H11-234241.*
(Continued)

*Primary Examiner* — Gennadiy Tsvey
(74) *Attorney, Agent, or Firm* — Vista IP Law Group, LLP

(57) ABSTRACT

A method for receiving wireless audio streams in a hearing device includes: receiving audio packages of a primary audio stream from a primary transmitter unit having a primary transmitter unit address; evaluating a first parameter of the primary audio stream; and if the first parameter fulfills a search criterion: searching for pilot packages from available transmitter units; determining an optimum transmitter unit based on one or more pilot package parameters of the pilot packages from the available transmitter units; and receiving audio packages of an audio stream from the optimum transmitter unit.

30 Claims, 9 Drawing Sheets

(56) References Cited

U.S. PATENT DOCUMENTS

| | | | | |
|---|---|---|---|---|
| 2006/0281477 | A1* | 12/2006 | Downes | H04L 12/2809 455/509 |
| 2007/0101228 | A1* | 5/2007 | Vesma et al. | 714/752 |
| 2007/0237185 | A1* | 10/2007 | Pereira | H04N 21/2389 370/503 |
| 2008/0062933 | A1 | 3/2008 | Liu et al. | |
| 2008/0094524 | A1* | 4/2008 | Schobben | H04R 5/04 348/738 |
| 2008/0144645 | A1* | 6/2008 | Russell | H04L 47/10 370/412 |
| 2008/0165709 | A1* | 7/2008 | Soliman | 370/280 |
| 2009/0022327 | A1* | 1/2009 | Braun | 381/1 |
| 2010/0150245 | A1* | 6/2010 | Camp, Jr. | H04N 21/2383 375/240.25 |
| 2010/0158292 | A1* | 6/2010 | Pedersen | 381/315 |
| 2011/0142268 | A1* | 6/2011 | Iwakuni | H04R 25/43 381/312 |
| 2011/0228944 | A1* | 9/2011 | Croghan | H04N 5/60 381/17 |
| 2011/0295397 | A1 | 12/2011 | Goldberg | |
| 2012/0231732 | A1 | 9/2012 | Kerselaers | |
| 2012/0321112 | A1 | 12/2012 | Schubert et al. | |

FOREIGN PATENT DOCUMENTS

| | | | |
|---|---|---|---|
| CN | 101572721 | A1 | 11/2009 |
| CN | 101755471 | A | 6/2010 |
| CN | 201499166 | U | 6/2010 |
| CN | 101998260 | A | 3/2011 |
| CN | 201780590 | U | 3/2011 |
| CN | 102779469 | A | 11/2012 |
| JP | H11-234241 | | 8/1999 |
| WO | WO 2004/054142 | | 6/2004 |
| WO | WO 2006/110445 | | 10/2006 |
| WO | WO 2009/062115 | | 5/2009 |
| WO | 2012/056298 | A2 | 5/2012 |

OTHER PUBLICATIONS

Second Technical Examination dated Jan. 6, 2014, for related Danish Patent Application No. PA 2013 70264, 2 pages.

First Technical Examination and Search Report dated Sep. 4, 2013, for related Danish Patent Application No. PA 2013 70264, 5 pages.

Extended European Search Report dated Sep. 11, 2013, for related European Patent Application No. 13167810.4, 7 pages.

Notice of Reasons for Rejection for JP Patent Application No. 2014-100764, dated Sep. 16, 2014 (6 pages).

Notification of First Office Action and Search Report dated Dec. 18, 2015 for related Chinese Patent Application No. 201410205642.5, 19 pages.

* cited by examiner

| |
|---|
| TRANSMITTER UNIT ADDRESS |
| AUDIO STREAM IDENTIFIER |
| AUDIO STREAM DATA |

(a)

| |
|---|
| TRANSMITTER UNIT ADDRESS |
| CHANNEL IDENTIFIER |
| TIME OFFSET |
| AUDIO STREAM IDENTIFIER |
| NETWORK IDENTIFIER |

(b)

Fig. 10

HEARING DEVICE AND A METHOD FOR RECEIVING WIRELESS AUDIO STREAMING

RELATED APPLICATION DATA

This application claims priority to, and the benefit of, Danish Patent Application No. PA 2013 70264, filed on May 15, 2013, and European Patent Application No. 13167810.4, filed on May 15, 2013. The entire disclosures of both of the above applications are expressly incorporated by reference herein.

FIELD

The present application relates to a hearing device configured for receiving audio streaming and an associated method, in particular a hearing device and a method for receiving an audio stream from an audio system transmitting using a plurality of transmitters.

BACKGROUND

Wireless communication to and from hearing devices has been increasing in continuation of the developments within wireless communication technology. In a crowded environment where audio is distributed to the crowd, for example in an airport or in a movie theatre, it is known to stream audio via a telecoil solution having a limited bandwidth with limited possibilities of separating different audio streams. The limited transmission range of known transmitters is a limiting factor for a user moving in a larger area, e.g. an airport. Further, the limited battery power of hearing devices compared to e.g. a smartphone, sets a limit to the possibilities of wireless communication.

SUMMARY

There is a need for a hearing device that enables reception of audio streams and a method that enables the hearing device of a moving user to continue the receiving of the audio stream when the user moves from a transmission area of one transmitter to a transmission area of a second transmitter.

Despite the known solutions there is still a need for a method of efficiently switching between receiving from one transmitter to receiving from a second transmitter with a minimum or at least a reduced power consumption of the hearing device.

Accordingly, a hearing device is provided, the hearing device comprising an antenna; a receiver unit coupled to the antenna and configured to wirelessly receive audio packages and pilot packages of audio streams; a processing unit coupled to the wireless receiver unit for receiving data via the antenna; and a receiver coupled to an output of the processing unit for conversion of an output signal into an output audio signal. The processing unit is configured to receive audio packages of a primary audio stream from a primary transmitter unit with a primary transmitter unit address via the wireless receiver unit and to evaluate a first parameter of the primary audio stream. If the first parameter fulfills a search criterion, the processing unit is configured to search for pilot packages from available transmitter units; determine and select an optimum transmitter unit based on one or more one pilot package parameters of pilot packages from available transmitter units; and receive audio packages of an audio stream from the optimum transmitter unit according to one or more pilot packages from the optimum transmitter unit.

Also disclosed is a method for receiving wireless audio streams in a hearing device. The method comprises receiving audio packages of a primary audio stream from a primary transmitter unit having a primary transmitter unit address, and evaluating a first parameter of the primary audio stream. If the first parameter fulfils a search criterion, the method comprises searching for pilot packages from available transmitter units; determining and selecting an optimum transmitter unit, e.g. based on one or more one pilot package parameters of pilot packages from available transmitter units; and receiving audio packages of an audio stream from the optimum transmitter unit according to one or more pilot packages from the optimum transmitter unit.

It is an advantage that simple switching between different transmitter units is provided substantially without affecting the quality of the audio stream.

It is an important advantage that transmission of data from the hearing device to the first and/or second transmitter is limited or not required (no handshaking) for switching between wireless audio streams, which provides a power efficient receipt of wireless data.

The hearing device may comprise a processing unit configured to compensate for hearing loss or disability of the hearing device user.

According to some embodiments, an easy and efficient method of a hearing device switching between wireless transmitters in response to fading signals or signal quality is provided.

A method for receiving wireless audio streams in a hearing device includes: receiving audio packages of a primary audio stream from a primary transmitter unit having a primary transmitter unit address; evaluating a first parameter of the primary audio stream; and if the first parameter fulfills a search criterion: searching for pilot packages from available transmitter units; determining an optimum transmitter unit based on one or more pilot package parameters of the pilot packages from the available transmitter units; and receiving audio packages of an audio stream from the optimum transmitter unit.

Optionally, the act of determining the optimum transmitter unit comprises: evaluating at least one of the one or more of the pilot packages from the available transmitter units; and if the at least one of the one or more pilot package parameters fulfills a switch criterion, determining a secondary transmitter unit from the available transmitter units as the optimum transmitter unit.

Optionally, the primary transmitter unit is selected as the optimum transmitter unit if the at least one of the one or more pilot package parameters does not fulfill the switch criterion.

Optionally, the switch criterion is fulfilled if the pilot package parameter of one of the available transmitter units is larger than a pilot package parameter of the primary transmitter unit.

Optionally, the act of determining the optimum transmitter unit comprises: evaluating at least one of the one or more pilot package parameters from the available transmitter units; and selecting the optimum transmitter unit based on the act of evaluating the at least one of the one or more pilot package parameters.

Optionally, at least one of the one or more pilot packages comprises a transmitter unit address of one of the transmitter units, a time offset, and a channel identifier of a following audio package, and wherein the audio packages of the audio stream from the optimum transmitter unit is received based on the time offset.

Optionally, at least one of the one or more pilot packages comprises an audio stream identifier, and wherein the act of determining the optimum transmitter unit is based on the audio stream identifier.

Optionally, the first parameter is a parameter indicative of signal strength of the primary audio stream.

Optionally, one of the one or more pilot package parameters is indicative of a pilot package signal strength.

Optionally, the search criterion is fulfilled if the first parameter is below or above a search threshold value.

Optionally, the act of searching for the pilot packages is performed in time intervals in which audio packages from the primary transmitter unit is not being received.

Optionally, the act of searching for the pilot packages comprises receiving data on one or more dedicated pilot channels.

Optionally, the optimum transmitter unit is determined based on best available signal strength.

A hearing device includes: an antenna; a receiver unit coupled to the antenna; a processing unit coupled to the receiver unit for receiving data via the antenna; a receiver coupled to an output of the processing unit for conversion of an output signal into an output audio signal; wherein the processing unit is configured to: receive audio packages of a primary audio stream transmitted wirelessly from a primary transmitter unit to the receiver unit, the primary transmitter unit having a primary transmitter unit address; evaluate a first parameter of the primary audio stream; wherein, if the first parameter fulfills a search criterion, the processing unit is configured to: search for pilot packages transmitted wirelessly from available transmitter units to the receiver unit; determine an optimum transmitter unit based on one or more one pilot package parameters of the pilot packages from the available transmitter units; and receive audio packages of an audio stream from the optimum transmitter unit.

Optionally, the hearing device further includes a microphone for conversion of an acoustic audio signal into an input audio signal.

Optionally, the processing unit is configured to compensate for hearing loss or hearing disability of a user of the hearing device.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only exemplary embodiments and are not therefore to be considered limiting to the scope of the claims.

FIGS. 10 (*a*) and (*b*) illustrate an exemplary audio package and an exemplary pilot package.

DETAILED DESCRIPTION

Figure 1:
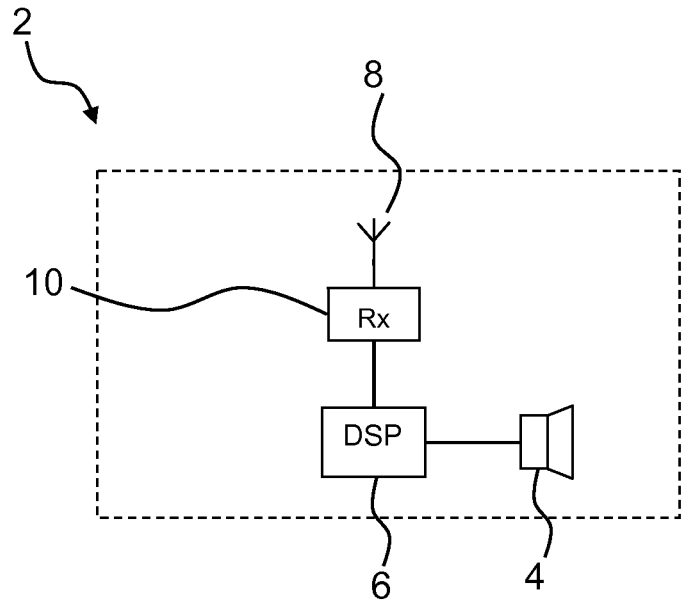
FIG. 1 schematically illustrates an exemplary hearing device.

Various embodiments are described hereinafter with reference to the figures. It should be noted that the figures are not necessarily drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. The claimed invention may be embodied in different forms and should not be construed as limited to the embodiments set forth herein. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The present disclosure relates to a hearing device and a method enabling receipt of audio stream(s) representing audio track(s) from an audio system and capable of automatic switching, i.e. switching without user input, between receiving a primary audio stream representing a first audio track from a primary transmitter unit to receiving a secondary audio stream representing the first audio track from a secondary transmitter unit.

In an audio system, one or more transmitter units are configured for broadcasting or transmitting audio stream(s), e.g. to one or more hearing devices. A transmitter unit may transmit one or more audio streams. A transmitter unit is identified by a transmitter unit address.

An audio track is an audible signal. Exemplary audible signals are an airport call, a movie sound track, speech or a piece of music.

An audio stream is an electromagnetic signal representative of an audio track. An audio stream is represented by a number of audio blocks each comprising one or more audio packages. An audio package comprises a finite part of an audio stream.

Figure 9:
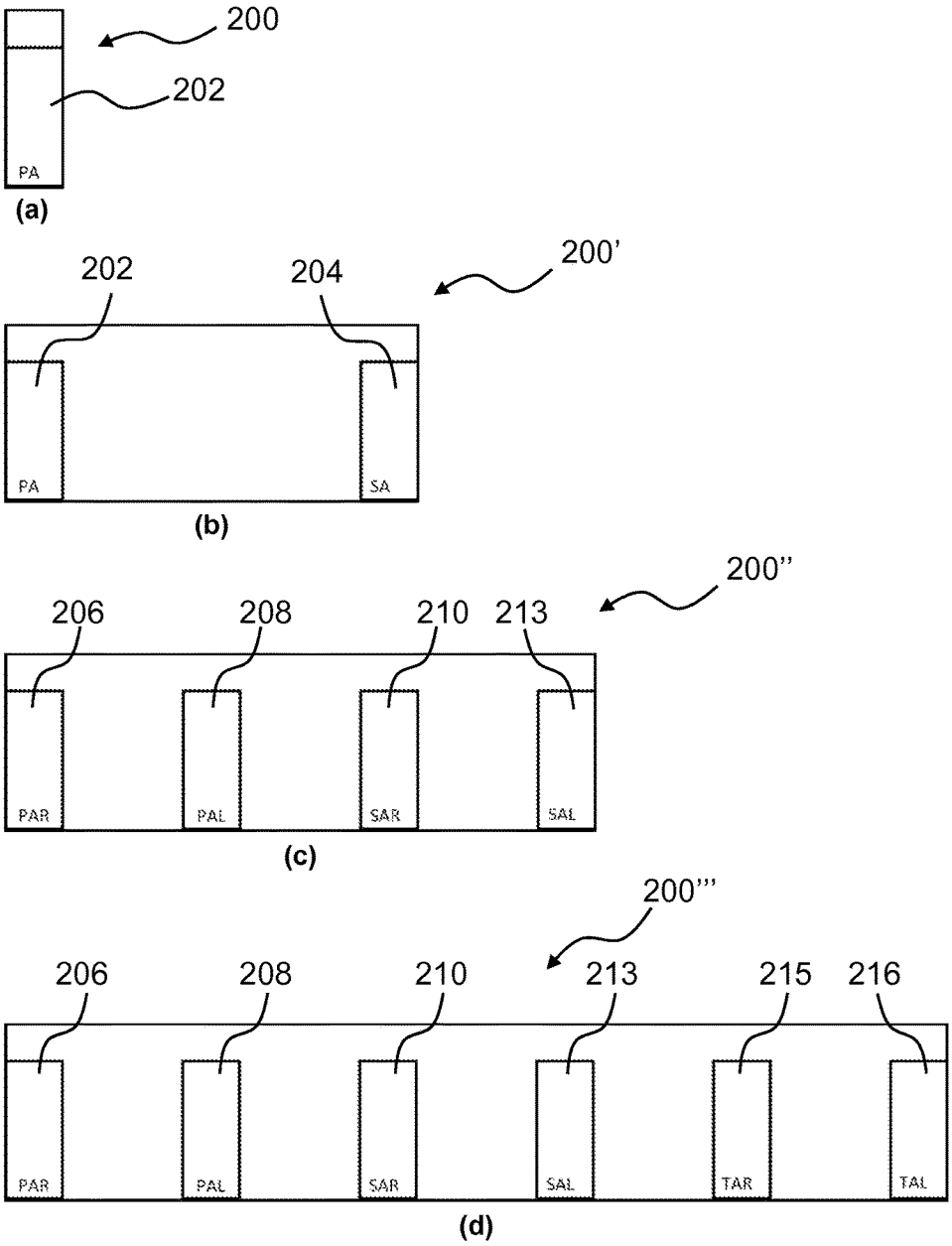

An audio block comprises one or more audio packages (see also FIG. 9(*a*) to (*d*) and corresponding description). An audio block may comprise one or more primary audio packages and/or one or more secondary audio packages. A secondary audio package may constitute a copy of a primary audio package allowing a hearing device to recover lost packages. Further, an audio block may comprise first audio packages and/or second audio packages for example constituting audio stream data for a left or a right ear, respectively. An audio block may comprise a first primary audio package and/or a second primary audio package. Further, a first secondary audio package and/or a second secondary audio package may be included in an audio block. Sending the same audio data in two or more audio packages provides improved quality of sound at the receiver An audio stream comprises a number of pilot packages. A pilot package comprises information about a subsequent such as the following or next audio block.

An audio frame (see also FIG. 4 and corresponding description) comprises an audio block with one or more audio packages, and optionally one or more pilot packages including a primary and/or a secondary pilot package. An audio frame may comprise a tertiary pilot package to further improve handover between transmitter units. An audio block may have a length between 0.240 ms and 8.0 ms, such as in the range from 0.380 ms to 6.8 ms, such as in the range from 2.0 ms to 3.5 ms, e.g. 2.85 ms.

An audio package (see also FIG. 10 (*a*) and corresponding description) may comprise an audio stream identifier, which may comprise one or more elements such as audio track identification, transmitter unit address, audio group identification etc. Audio track identification may enable selection of audio streams representative of the same audio track, and audio group identification may identify a certain group of audio tracks or audio streams e.g. an audio group may be audio tracks in the same or similar language, e.g. English, Danish or Chinese.

An audio package may comprise transmitter unit address of the transmitter unit transmitting the audio package, thus enabling the hearing device to sort out audio packages sent from other transmitter units.

A pilot package (see also FIG. 10 (*b*) and corresponding description) may comprise information enabling receipt of a subsequent such as the following audio block from the transmitter unit sending the audio stream in question. A pilot package comprises one or more time offsets indicative of timing between packages in the audio stream. Further, a pilot package may comprise a channel identifier. A channel identifier indicates the channel (RF) of audio package(s) in a subsequent such as the following or next audio block. Even further, a pilot package may comprise transmitter unit address and/or audio stream identifier. A pilot package may comprise network identifier or other data indicative of a group of transmitter units, thereby enabling a hearing device to select or limit searching for pilot packages of a group of transmitter units. A pilot package from a transmitter unit enables a hearing device to receive a subsequent such as the following audio block from the transmitter unit in question by configuring the hearing device in accordance with information comprised within the received pilot package. A primary pilot package in an audio block may comprise transmitter unit address, a primary time offset, and channel identifier of the first primary audio package of a subsequent such as the following audio block. A secondary pilot package in an audio block may comprise transmitter unit address, a secondary time offset, and channel identifier of the first primary audio package of a subsequent such as the following audio block.

A time offset comprised within the pilot package may indicate the time of transmittal of a subsequent such as the following audio block. The time offset may e.g. be the time from start of transmission of the pilot package to the time of start of transmission of a subsequent such as the following audio block and/or to the time of start of transmission of an audio package in a subsequent such as the following audio block.

The channel identifier or RF channel identifier comprised within the pilot package may be indicative of the channel where the following audio block is transmitted. A channel is indicative of the frequency or frequency range on which an (first) audio package of the following audio block is sent.

The transmitter unit address comprised within the pilot package may be transmitter unit address of the transmitter unit from where the pilot package was transmitted, thus enabling the hearing device to identify the transmitter unit from where it may receive following audio packages corresponding to the pilot package in question.

An audio frame may have a time duration or period length T. Period length T may be defined as being from start of transmission of an audio block to the start of transmission of the following audio block. T may be defined as being the time from start of transmission of the first primary audio package of the first audio block to the start of transmission of the first primary audio package of the second audio block. The period length T may be fixed e.g. be a time of between 2 ms and 20 ms, such as between 5 ms and 12 ms or such as between 6 ms and 10.2 ms, or between 6 ms and 6.5 ms, or between 7.2 ms and 7.7 ms, or between 9.8 ms and 10.2 ms. A long period length T may be beneficial for providing increased possibility of power saving in a hearing device, as a long period length T provides for a long duration where the receiver may be switched off. However, a long T leads to an increased latency, meaning that a long T is not sufficient if the audio needs to be synchronized with e.g. a movie. Hence a short T is beneficial if the audio is to be synchronized with another input, or is to be happening as close to real time as possible.

The audio system may comprise a first transmitter unit and optionally a second transmitter unit or optionally any number of a plurality of transmitter units.

Transmitting and receiving the wireless audio stream may be achieved by using wireless technology, thus transmitting/receiving audio blocks at one or more frequencies, e.g. in the range from 2.4 GHz to 2.5 GHz, in the range from 800 MHz to 1 GHz, in the range from 3.6 GHz to 3.7 GHz, and/or in the range from 4.9 GHz to 5.9 GHz.

A pilot package is sent and/or received on a pilot channel. Pilot packages may be transmitted and/or received on pilot channels selected from one or more available channels. The pilot channel for a pilot package may be selected from a subset of available channels, thus further reducing load on the hearing device during search for available transmitter units, by allowing the hearing device to only need to listen for pilot packages of available transmitter units at known pilot channel(s). The channel(s) for pilot packages may be at one or more frequencies, e.g. in the range from 2.4 GHz to 2.5 GHz, in the range from 800 MHz to 1 GHz, in the range from 3.6 GHz to 3.7 GHz, and/or in the range from 4.9 GHz to 5.9 GHz.

Pilot package(s) may be transmitted/received in the same frequency range as audio blocks. Alternatively or in combination, pilot packages may be transmitted in a different frequency range than audio blocks and/or by using a different modulation scheme. Pilot package(s) may be transmitted/received within an audio block, i.e. a pilot package may be interleaved within an audio block.

Transmission and/or receipt of pilot packages may be performed using a frequency hopping scheme, i.e. the pilot channel may be selected according to a frequency hopping scheme, for example between three or more channels. The frequency hopping scheme may be random or pseudo-random or predetermined.

The first parameter of the primary audio stream may be a parameter indicative of signal strength and/or signal quality of the primary audio stream or one or more audio blocks or audio packages of the primary audio stream. The first parameter of the primary audio stream may be a parameter indicative of or including signal strength or signal quality of pilot packages of the primary audio stream. The first parameter may be Received Signal Strength Indication (RSSI) of the primary audio stream or of one or more selected audio and/or pilot packages of the primary audio stream.

In exemplary method(s), the first parameter may be or comprise Received Channel Power Indicator (RCPI).

In exemplary method(s), the search criterion may be fulfilled if the first parameter is below or above a search threshold value, for example if the RSSI of the primary audio stream is below or above a search threshold value, e.g. a first threshold value, depending on whether a high or low RSSI, respectively, indicates high signal quality.

The search criterion may comprise a combination of one or more logical expressions evaluating whether one or more parameters is above, below and/or equal to one or more search threshold values, respectively.

A pilot package parameter (p) is a parameter indicative of one or more characteristics of a pilot package, such as signal strength. A pilot package parameter may be a function of one or more characteristics of pilot packages from respective transmitter units. The pilot package parameter may be based on RSSI of one or more pilot package.

The first pilot package parameter from each available transmitter unit may be a function of the signal strength (RSSI) of one or more pilot packages from the respective transmitter unit. The first pilot package parameter may comprise an averaging function, for example based on RSSI values for pilot packages.

The first pilot package parameter may be a function of pilot package characteristics for pilot packages from two or more audio frames. Accordingly, searching for pilot packages from available transmitter units and determining and selecting an optimum transmitter unit may be performed, while the hearing device receives and processes audio blocks from the primary transmitter unit. Including characteristics from a plurality of pilot packages may ensure an improved switching scheme since random packet losses or errors may be taken into account, e.g. in order to avoid unnecessary switching between transmitter units.

Receiving audio packages of a primary audio stream comprises receiving audio packages from a primary transmitter unit (not shown) with a transmitter unit address.

Evaluation of the first parameter may comprise evaluation of one or more different characteristics such as signal strength, signal quality and/or rate of errors.

Searching for pilot packages may be initiated if the first parameter fulfills a search criterion. The processing unit may return to receiving audio packages/evaluation of the first parameter, if the first parameter does not fulfill the search criterion. The search criterion may be such as whether or not the signal strength of the received audio packages from the first transmitter is satisfactory, e.g. if signal quality is below a given threshold, if the error rate is above a certain threshold and/or if a predetermined timeout has passed. Incorporating a predetermined timeout in the search criterion enables setting a maximum time between searches, e.g. to ensure that the search is initiated on a regular basis, e.g. at least every 10 seconds. Alternatively or additionally, a minimum time between consecutive searches may also be incorporated in the search criterion, in order to reduce power consumption.

The pilot packages may be received from available transmitter units and evaluated according to one or more parameters including but not limited to signal strength, signal quality, audio stream identifier, and/or rate of errors.

Determining and selecting an optimum transmitter unit may comprise evaluating at least one pilot package parameter, including a first pilot package parameter, for one or more pilot packages from available transmitter units. Evaluating at least one pilot package parameter may comprise comparing a first pilot package parameter of pilot packages from the primary transmitter unit with a first pilot package parameter of pilot packages from available secondary transmitter units. Further, if the at least one pilot package parameter fulfils a switch criterion, the method may comprise selecting a secondary transmitter unit from the available transmitter units as the optimum transmitter unit.

The method may comprise selecting the primary transmitter unit as the optimum transmitter unit if the at least one pilot package parameter does not fulfil the switch criterion, i.e. the hearing device continues to receive audio packages from the primary transmitter unit if a better transmitter unit is not found.

The switch criterion may be fulfilled if the first pilot package parameter of an available secondary transmitter unit is larger than the first pilot package parameter of the primary transmitter unit. The secondary transmitter unit with the best first pilot package parameter, e.g. largest RSSI, may then be selected as the optimum transmitter unit.

In the method, selecting the optimum transmitter unit may be based on the evaluation of at least one pilot package parameter of available transmitter units including the primary transmitter unit if available.

Receiving audio packages of an audio stream from the optimum transmitter unit may be based on the time offset of a pilot package. Accordingly, the processing unit may be configured to control the receiver unit according to the time offset in a pilot package.

Determining and selecting an optimum transmitter unit may be based on the audio stream identifier. Thereby is prevented that a transmitter unit sending a different audio stream is selected. Transmitter units not sending the desired audio stream or not belonging to the desired group of transmitter units may be filtered out in the receiver unit during searching for pilot packages in order to reduce processing in the processing unit.

In methods employing a switch criterion, the method may return to receiving audio packages from the primary transmitter unit if the switch criterion is not fulfilled. The switch criterion may be such as whether or not the pilot package parameters for secondary transmitter unit pilot packages are larger than pilot package parameter of the primary transmitter unit pilot packages.

If the switch criterion is fulfilled and/or a secondary transmitter unit is selected as the optimum transmitter unit, the processing unit configures the wireless receiver unit for receiving audio packages from the secondary transmitter unit according to information in pilot packages (time offset and RF channel identifier) received from the secondary transmitter unit.

The processing unit may be configured to turn off the wireless receiver unit in one or more time intervals of an audio frame, e.g if the first parameter does not fulfil the search criterion. The wireless receiver unit may be configured to receive audio packages of audio streams at frequencies in the range from 2.4 GHz to 2.5 GHz and/or in the range from 800 MHz to 1 GHz.

FIG. 1 schematically illustrates an exemplary hearing device. The hearing device 2 comprises a loudspeaker or receiver 4, a processing unit 6, an antenna 8 and a wireless receiver unit 10. The wireless receiver unit 10 is coupled to the antenna 8 and configured to receive audio packages of an audio stream and pilot packages of a plurality of audio streams. The processing unit 6 is configured to compensate for hearing loss or hearing disability of the hearing device user and is coupled to the wireless receiver unit 10 for receiving data via the antenna 8 and/or for exchanging control signals between the receiver unit 10 and the processing unit 6. The loudspeaker 4 is coupled to an output port of the processing unit for conversion of an output signal into an output audio signal. The processing unit 6 is configured to receive audio packages of a first audio stream via the wireless receiver unit 10, and evaluate a first parameter of the first audio stream. In the hearing device 2, RSSI (Received Signal Strength Indicator) is the first parameter, and the receiver unit 10 calculates RSSI and feeds RSSI to the processing unit 6. Other parameters indicative of signal quality or combinations thereof may be used as a first parameter. If the first parameter fulfills a search criterion, e.g. if RSSI falls below a search threshold value, i.e. the signal quality is dropping below an acceptable level (high RSSI indicates good signal quality), the processing unit 6 searches for pilot packages from available transmitter units by controlling the receiver unit 10 accordingly. After searching, e.g. for a predetermined time period or number of audio frames, or until a number of pilot packages are received, the processing unit 6 determines and selects an optimum transmitter unit, e.g. based on one or more one pilot package parameters including a first pilot package parameter ($p_{1,1}$, . . . , $p_{1,N}$) of pilot packages from N available transmitter units.

Upon selection of an optimum transmitter unit, the processing unit 6 controls the wireless receiver unit 10 to receive audio packages of an audio stream from the optimum transmitter unit according to at least the latest pilot package from the optimum transmitter unit. The processing unit 6 is optionally configured to compensate the received audio stream for hearing loss or disability of the hearing device user.

Figure 2:
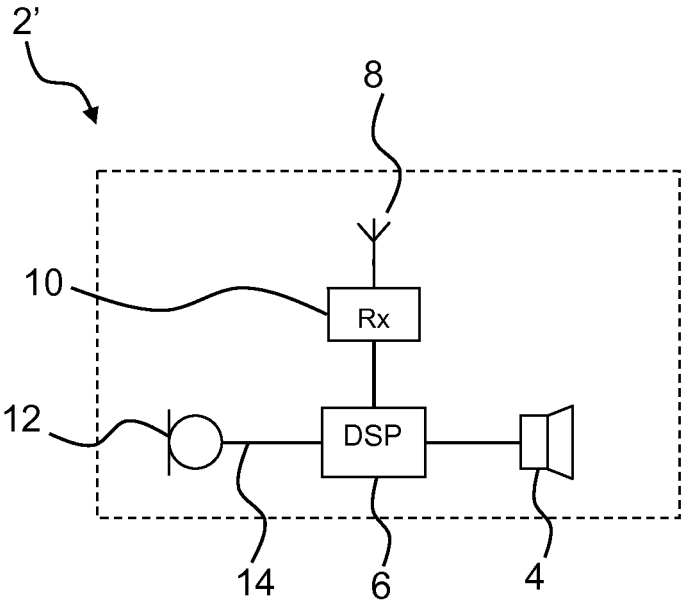
FIG. 2 schematically illustrates an exemplary hearing device.

FIG. 2 schematically illustrates an exemplary hearing device. The hearing device 2' comprises the same features as the hearing device 2 in FIG. 1. Additionally, the hearing device 2' comprises a microphone 12. The microphone 12 is coupled to the processing unit 6 for conversion of an acoustic audio signal into an electronic representation of the acoustic audio signal 14 that is sent to the processing unit 6. The processing unit 6 is configured to compensate the received audio stream and/or the electronic representation for hearing loss or disability of the hearing device user.

Figure 3:
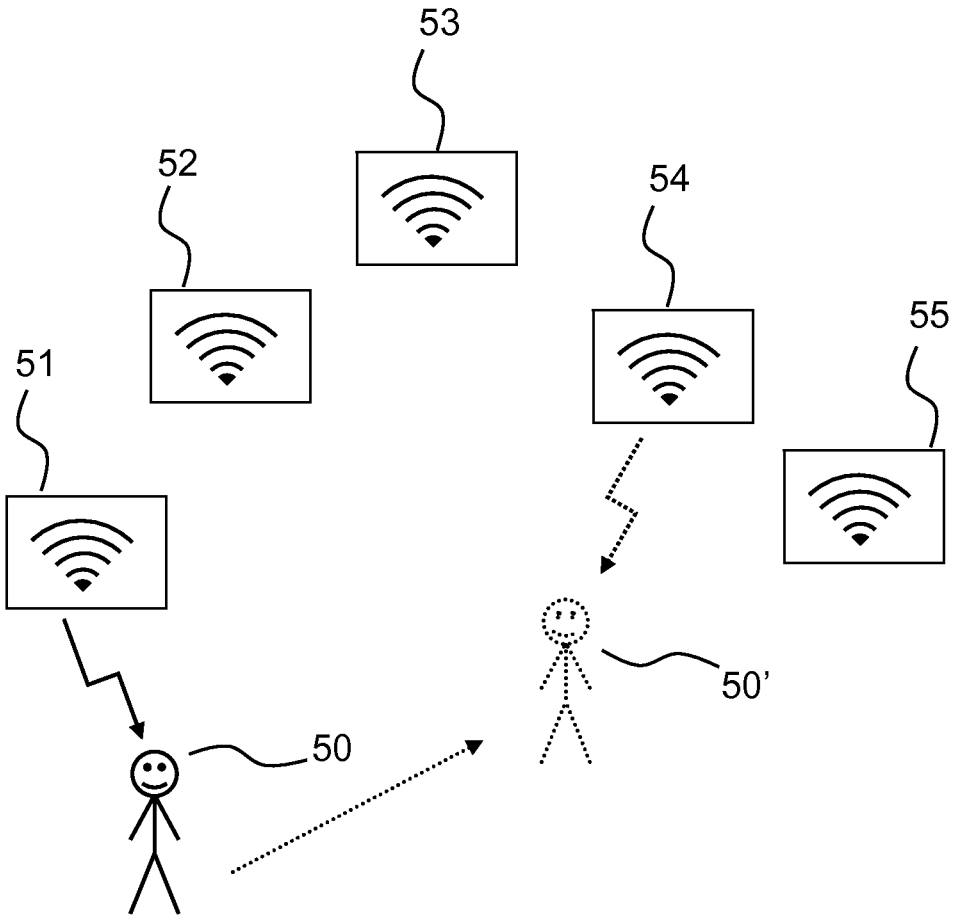
FIG. 3 schematically illustrates use of an exemplary hearing device.

FIG. 3 schematically illustrates use of an exemplary hearing device for receiving audible information from an audio system comprising a plurality of transmitter units 51, 52, 53, 54, 55. The transmitter units 51, 52, 53, 54, 55 are distributed in an area.

A user wearing a hearing device (not shown), is located in a first position 50 in the area and receives an audio stream from a first transmitter unit 51 acting as the primary transmitter. When the user moves to a second position 50' or e.g. the user turns his/her head or the receiving conditions otherwise change, the audio stream signal transmitted from the first transmitter unit 51 may become weak, e.g. due to the limited transmission range of the transmitter unit or limited penetration properties of the wireless signal. The hearing device detects that the signal quality is decreasing (search criterion fulfilled) and performs a search for available transmitter units, which is facilitated by receiving pilot packages of available transmitter units of the plurality of transmitter units 51, 52, 53, 54, 55. As illustrated, the hearing device identifies the fourth transmitter unit 54 as the optimum transmitter unit transmitting the same audio track by evaluating at least one pilot package parameter, e.g. RSSI, of received pilot packages, and selects the fourth transmitter unit 54 as the optimum transmitter unit and starts receiving audio packages therefrom according to one or more pilot packages from the fourth transmitter unit 54.

Figure 4:
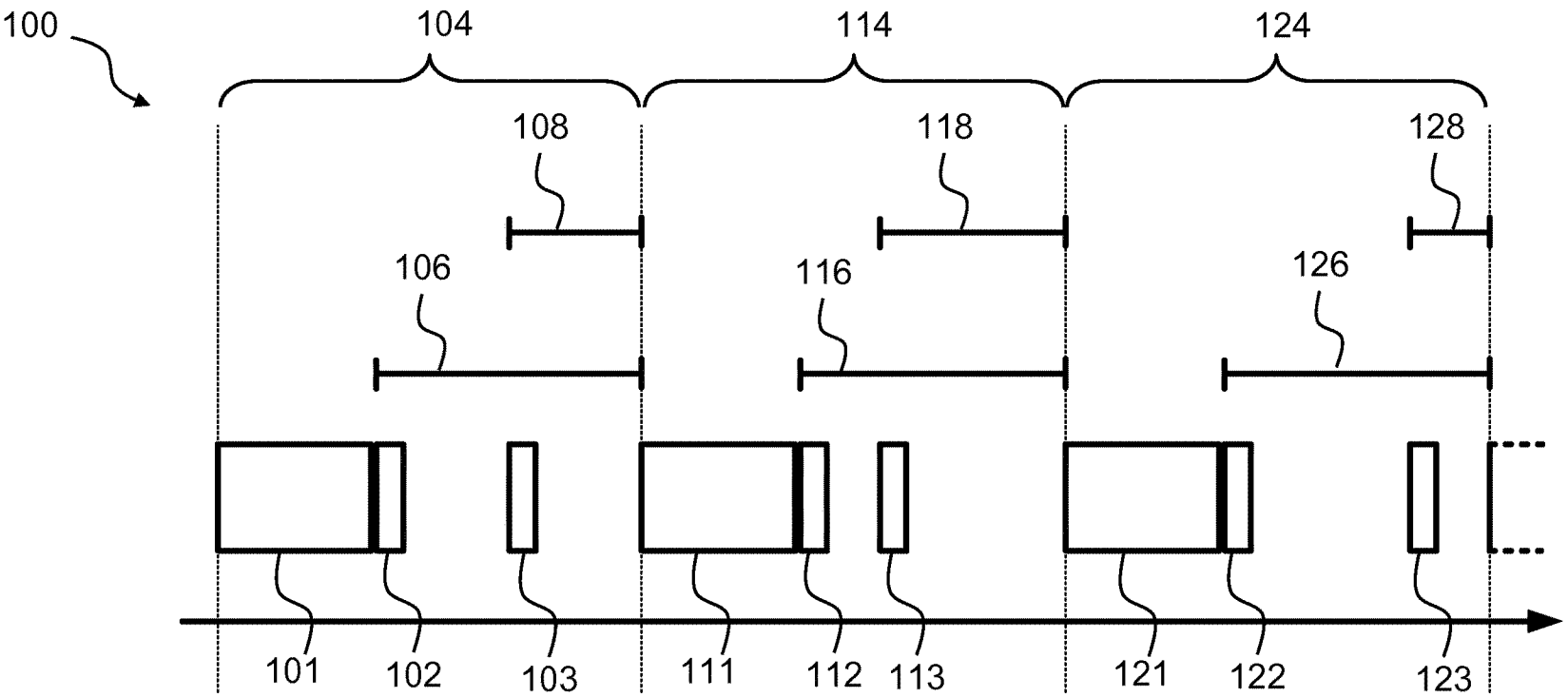
FIG. 4 schematically illustrates an electromagnetic signal.

FIG. 4 schematically illustrates a part of an exemplary audio stream as an electromagnetic signal 100 transmitted from any of the transmitter units 51, 52, 53, 54, 55 as illustrated in FIG. 3.

The audio stream/electromagnetic signal 100 represents an audio track and is divided into audio frames 104, 114, 124. Each audio frame comprises an audio block 101, 111, 121, a primary pilot package 102, 112, 122, and optionally a secondary pilot package 103, 113, 123. The audio blocks 101, 111, 121 comprise at least a first primary audio package (not shown) and may in addition comprise any number of audio packages. The number of audio packages does not need to be the same for all audio blocks.

The first audio frame 104 starts by a first primary audio package of the first audio block 101 being transmitted. After transmitting the first primary audio block 101, a first primary pilot package 102 is transmitted. Optionally, a first secondary pilot package 103 is transmitted in the first audio frame. The first secondary pilot package 103 may be transmitted at an arbitrary time during the first audio frame, preferably between transmission of the first primary pilot package and transmission of the second audio block 111. A primary pilot package may be transmitted within the audio block of the respective audio frame.

The first primary pilot package 102 comprises information as to how (channel identifier) and when (time offset) to receive the first primary audio package of the second audio block 111. The first primary pilot package 102 comprises a first primary timeoffset 106 indicating the time from transmittal of the first primary pilot package 102 to transmittal of the first primary audio package of the second audio block 111 of the second audio frame 114.

The first secondary pilot package 103 comprises, as the first primary pilot package, information as to how (channel identifier) and when (time offset) to receive the first primary audio package of the second audio block 111. Among a number of information the first secondary pilot package 103 comprises a first secondary timeout 108 indicating the timeout from transmittal of the first secondary pilot package 103 before transmittal of the first primary audio package of the second audio block 111 of the second audio frame 114.

In an exemplary electromagnetic signal, the duration or period length of an audio frame 104, 114, 124 is constant, and may e.g. be a time of between 2 ms and 20 ms, such as between 5 ms and 12 ms or such as between 6 ms and 10.2 ms, or between 6 ms and 6.5 ms, or between 7.2 ms and 7.7 ms, or between 9.8 ms and 10.2 ms.

The primary pilot packages 102, 112, 122 may be transmitted at a time within the audio frame resulting in that the primary time offset 106, 116, 126 is fixed and equal for all audio frames 104, 114, 124. The secondary pilot packages 103, 113, 123 may be transmitted at a time chosen randomly or pseudo randomly, resulting in a random or pseudo random secondary time offset 108, 118, 128. It is to be understood that the time offsets of pilot packages within the same audio frame indicates to the same transmittal time of the first primary audio package of the following audio block.

Figure 5:
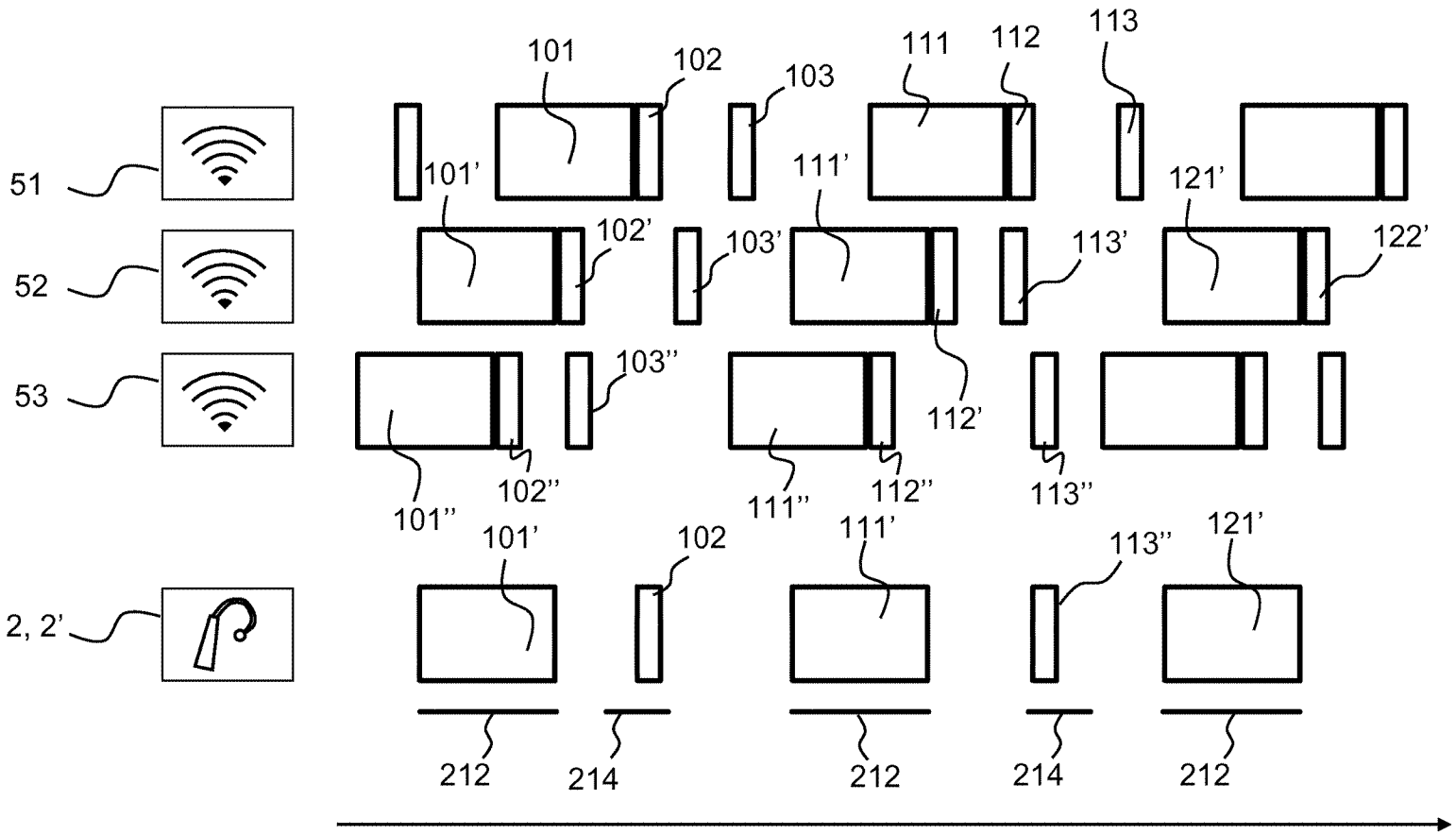
FIG. 5 schematically illustrates receiving in a hearing device an electromagnetic signal from one of a plurality of transmitter units, FIG. 6 schematically illustrates receiving in a hearing device an electromagnetic signal from one of a plurality of transmitter units.

FIG. 5 schematically illustrates receiving in a hearing device an audio stream/electromagnetic signal from one or more of a plurality of available transmitter units. FIG. 5 illustrates three transmitter units 51, 52, 53 each transmitting an electromagnetic signal in accordance with the description of the electromagnetic signal 100 of FIG. 4.

A hearing device, e.g. hearing device 2, 2', receives audio packages of audio blocks 101' from the second transmitter unit 52 acting as primary transmitter unit in receive period 212. If an evaluation of the received audio packages in audio block 101' yields a demand for an alternative audio source, i.e. if the search criterion is fulfilled, the hearing device 2, 2' searches for pilot packages sent from available transmitters 51, 52, 53 in one or more search periods 214 followed by an evaluation of the pilot package parameter(s). In the illustrated example, the evaluation shows that the second transmitter unit 52 despite the low signal quality still provides the best available signal quality and the hearing device continues to receive audio blocks from the second transmitter unit acting as primary transmitter unit, i.e. a new transmitter unit is not selected. The receive periods 212 of the hearing device may be extended such that primary pilot packages from the primary transmitter are received in order to evaluate the signal quality (first parameter) based on primary pilot packages 102', 112' and 122' from the primary transmitter unit.

The search period 214 may vary in time and/or in duration, and may be conducted when the hearing device 2, 2' is not receiving audio packages 212. In the example of FIG. 5, the search during search periods 214 leads to reception of pilot packages from two alternative transmitter units 51, 53.

Figure 6:
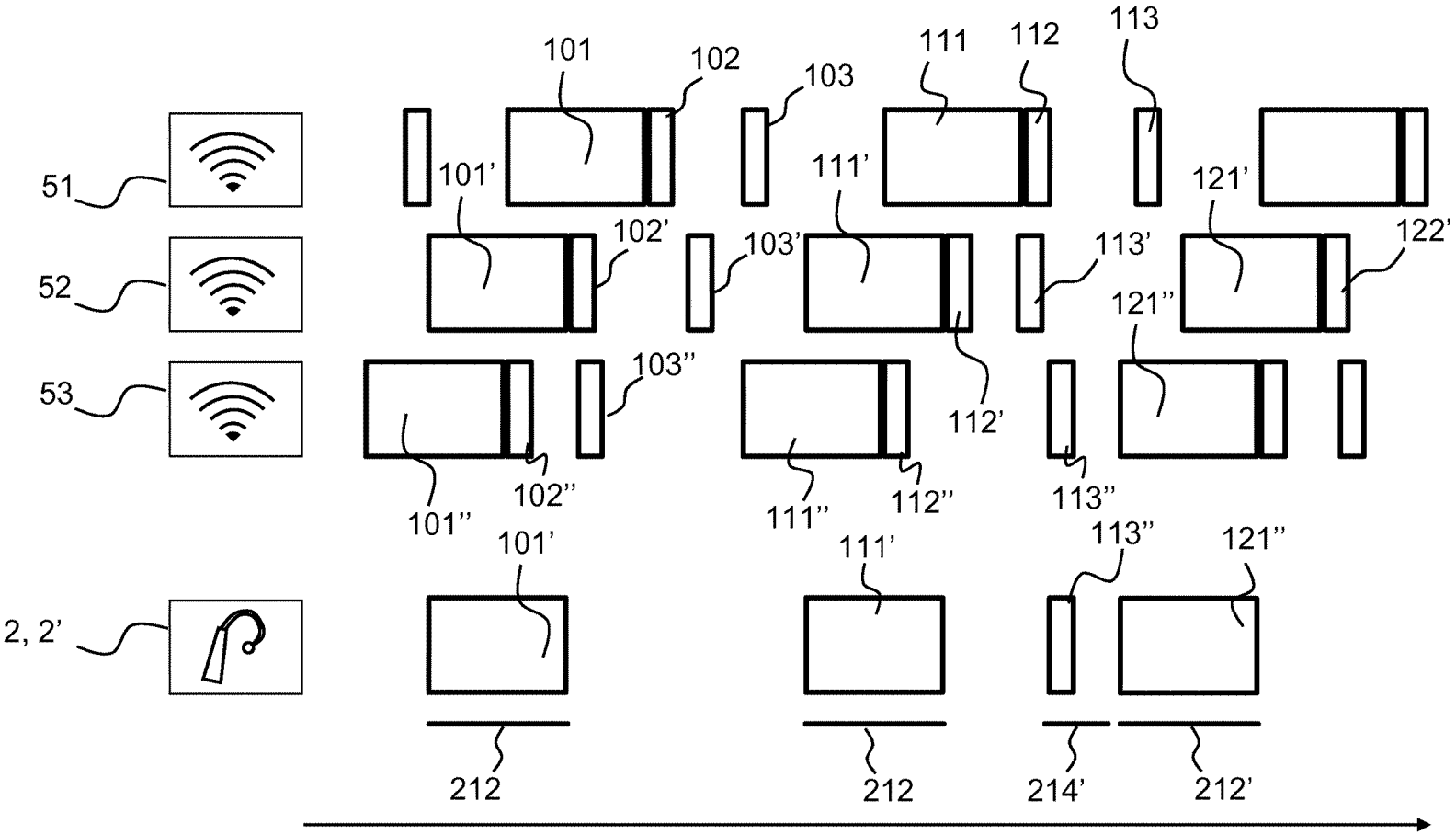

FIG. 6 schematically illustrates receiving in a hearing device an electromagnetic signal from one of a plurality of available transmitter units. FIG. 6 illustrates a similar transmission setup as described in FIG. 5. No search is initiated after receipt of the first audio block 101' and optionally first primary pilot package 102' during receive period 212 since the RSSI is high and the search criterion not fulfilled. Accordingly, the hearing device 2, 2' continues receiving the second audio block 111' and optionally the second primary pilot package from the second transmitter unit 52 acting as primary transmitter unit. The hearing device then determines that the search criterion is fulfilled and searches 214' for available transmitter units by searching for pilot packages on one or more pilot channels. Upon receipt of the pilot package 113", the hearing device selects the third transmitter unit 53 as the optimum transmitter unit and starts receiving during receive period 212' the audio package 121" from the third transmitter unit 53 according to information included in the pilot package 113", such as time offset and channel identifier. The reception of pilot package 113" during search period 214' leads to a switch of transmitter unit, thus the following reception 212' of audio package is configured according to parameters of the pilot package 113" received during search 214' and audio package 121" is received from the third transmitter unit 53. A reason for not switching according to an earlier received pilot package, e.g. pilot package 113", may be such as a too weak signal and/or an incorrect audio track.

Figure 7:
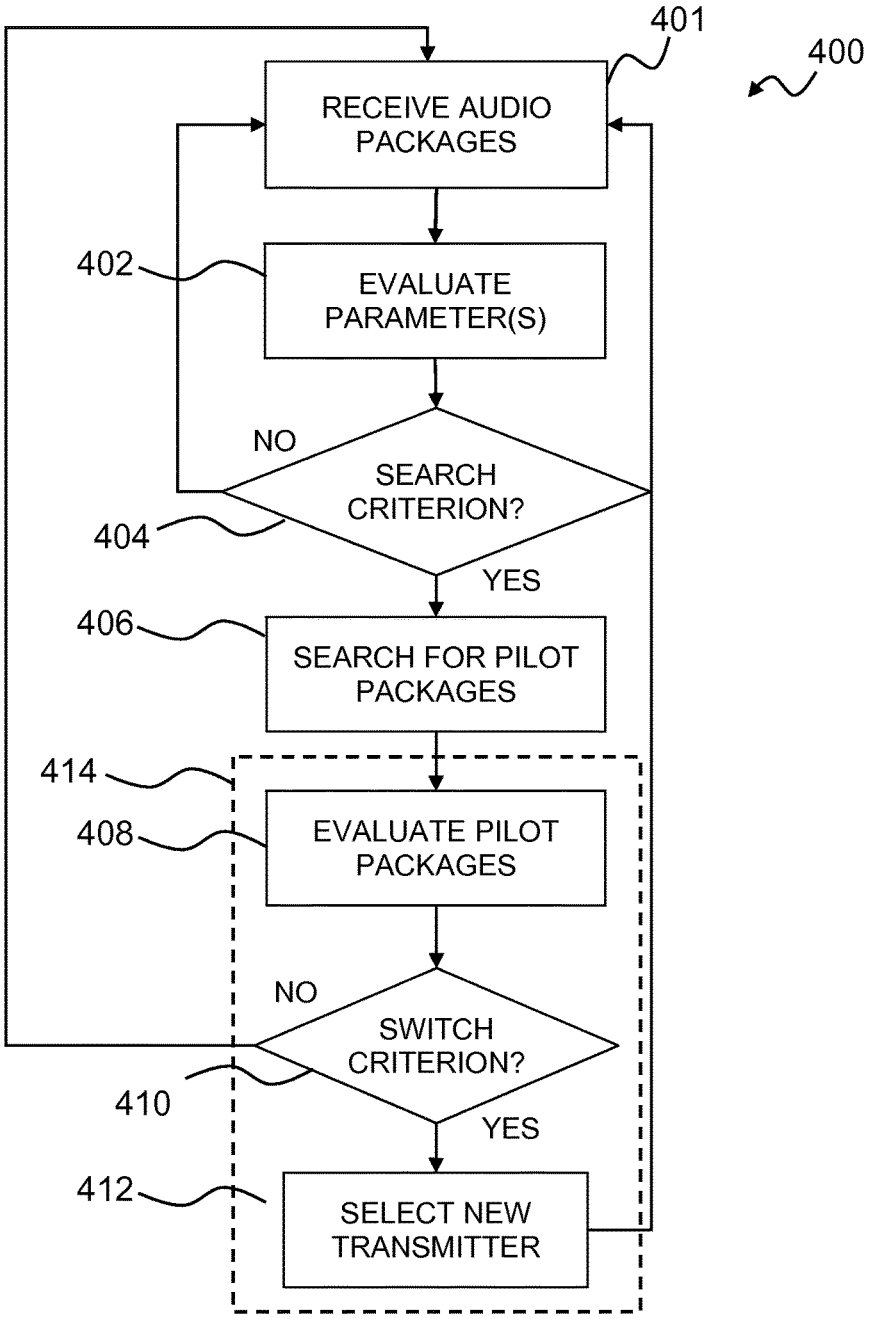
FIG. 7 is a flow diagram of an exemplary method according to some embodiments.

FIG. 7 is a flow diagram of an exemplary method according to some embodiments. The method 400 illustrated is designed to be performed while the user of e.g. a hearing device continuously receives an audio stream, hence do not interrupt the receiving and playback of an audio stream. The method 400 comprises receiving 401, e.g. via a wireless receiver unit, audio packages of a primary audio stream from a primary transmitter unit having a primary transmitter unit address. The method comprises evaluating 402 at least a first parameter of the audio stream being received from the primary transmitter. The parameter evaluation 402 may comprise different elements such as signal strength, signal quality and/or error rate. If the first parameter fulfils a search criterion 404, the method comprises searching 406 for pilot packages from available transmitter units. Searching for pilot packages may comprise searching for pilot packages with predetermined properties, e.g. a transmitter unit address and/or audio stream identifier, network identifier or other data indicative of a group of transmitter units. Searching for pilot packages may comprise searching for pilot packages on one or a set of pilot channels. Pilot packages may be received on channels different from the audio channels used for receipt of audio blocks/packages. The search criterion may comprise one or more logical expressions, e.g. whether or not the first parameter is below or above a search threshold and/or if a predetermined timeout has passed. The first parameter may be indicative of or comprise error rate. If the search criterion is not met, the method 400 proceeds with receiving 401 audio packages from the primary transmitter unit. Receiving audio packages from the primary transmitter and searching for pilot packages may be performed in parallel or in a multiplexing scheme during on or more audio frames.

Upon searching for pilot packages from available transmitter units, the method 400 proceeds to determining and selecting 414 an optimum transmitter unit based on one or more one pilot package parameters of pilot packages from available transmitter units. In the method 400, determining and selecting 414 comprise evaluating the received pilot packages found during searching 406 by evaluating 408 at least one pilot package parameter, including a first pilot package parameter, for one or more pilot packages from each available transmitter unit. If a switch criterion is fulfilled 410, i.e. if a secondary transmitter unit different from the primary transmitter unit provides a better signal or higher signal quality, the method 400 proceeds to selecting the secondary transmitter unit as new transmitter unit, i.e. switching to a new transmitter unit. The switch criterion may be fulfilled if a pilot package parameter of the primary transmitter unit is less than a pilot package parameter of the secondary transmitter unit having the largest pilot package parameter. The switch criterion may be fulfilled if a pilot package parameter of the primary transmitter unit is larger than a pilot package parameter of the secondary transmitter unit having the lowest pilot package parameter.

If the switch criterion is not met, the method 400 or hearing device returns to receiving audio packages from the primary transmitter. If the switch criterion 410 is met, a secondary transmitter unit is selected 412 as the optimum transmitter unit, and audio packages are received 401 from the secondary transmitter unit according to a time offset and a channel identifier included in the pilot package from the secondary transmitter unit.

Figure 8:
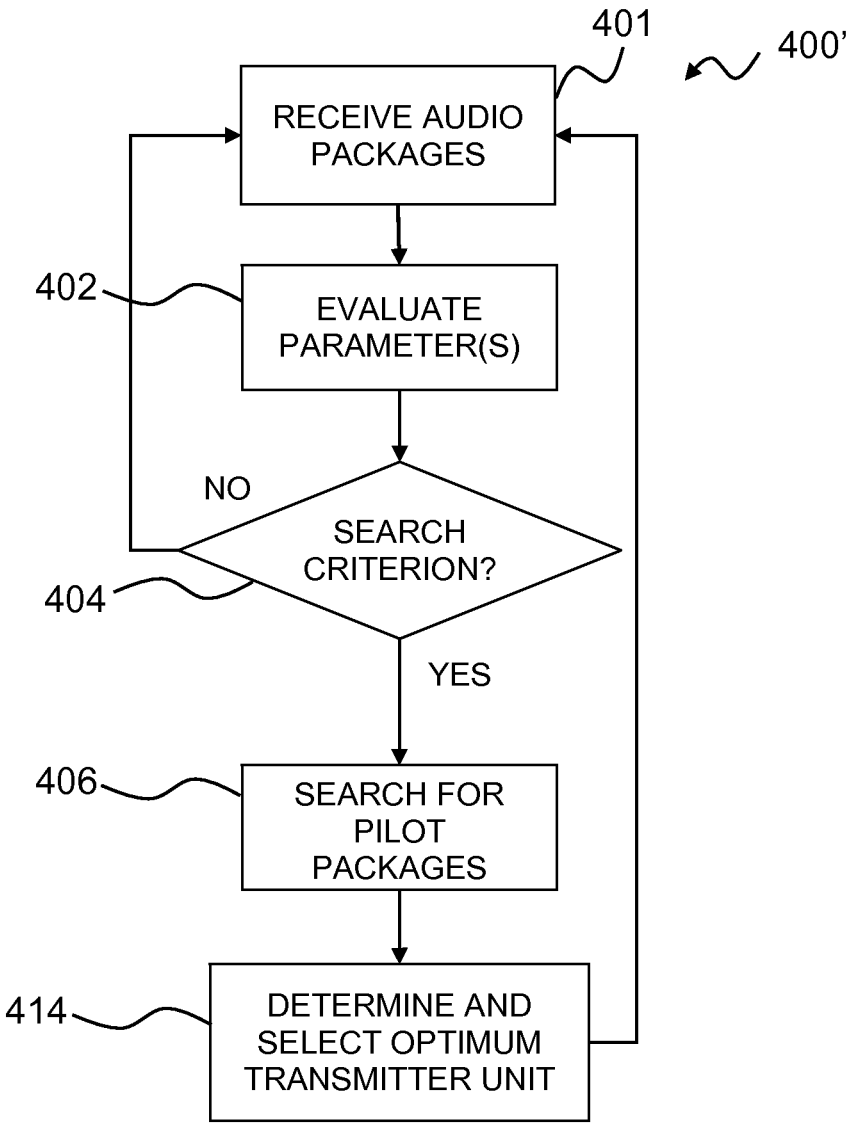
FIG. 8 is a flow diagram of an exemplary method according to some embodiments, FIG. 9 (*a*) to (*d*) illustrate exemplary audio blocks.

FIG. 8 is a flow diagram of an exemplary method 400' according to some embodiments. The method comprises determining the optimum transmitter unit by selecting the transmitter unit with the best pilot package parameter (e.g. max or min) from the received pilot packages.

FIG. 9 (*a*) to (*d*) illustrate four different exemplary audio blocks 200, 200', 200", 200'" sent from transmitter units. FIG. 9(*a*) illustrates an audio block 200 comprising a primary audio package 202, e.g. a mono audio signal. FIG. 9(*b*) illustrates an audio block 200' of an exemplary mono signal comprising a primary audio package 202 and a secondary audio package 204. The secondary audio package 204 may be a copy of the primary audio package 202, to enhance chances of a successful reception of data in a hearing device. FIG. 9(*c*) illustrates an audio block 200" of an exemplary stereo signal. The audio block 200" in FIG. 9(*c*) comprises a first primary audio package 206 and a second primary audio package 208 for right and left ear, respectively. The audio block 200" illustrated in FIG. 9(*c*) further comprises a first secondary audio package 210 and a second secondary audio package 213. The first secondary audio package 210 may be a copy of the first primary audio package 206, and the second secondary audio package 213 may be a copy of the second primary audio package 208. FIG. 9(*d*) illustrates an audio block 200" of an exemplary stereo signal. The audio block 200'" illustrated in FIG. 9*d* comprises a first tertiary audio package 215 and a second tertiary audio package 216. The first tertiary audio package 215 may be a copy of the first secondary right audio package 210 and/or the first primary audio package 206. The second tertiary audio package 216 may be a copy of the second secondary audio package 213 and/or the second primary audio package 208. A "copy of" means that at least the audio data of the audio packages are identical.

FIG. 10(*a*) illustrates an exemplary audio package comprising transmitter unit address, optional audio stream identifier, and audio stream data. Transmitter unit address may be indicative of the transmitter unit from which the audio package was transmitted. Audio stream identifier may comprise data indicative of the audio stream, e.g. audio track identification, audio group identification etc. Audio stream data comprises a finite part of the audible information forming the audio stream.

FIG. 10(*b*) illustrates an exemplary primary and/or secondary pilot package comprising transmitter unit address, channel identifier, time offset, optional audio stream identifier, and optional network identifier. Transmitter unit address may be indicative of the transmitter unit from which the pilot package was transmitted. Channel identifier may be indicative of the channel where the next audio block of the audio stream is transmitted, i.e. the channel identifier may be a frequency or a number indicating a frequency. Time offset may be indicative of when the next audio block is transmitted. Audio stream identifier may comprise data indicative of the audio stream, e.g. audio track identification, audio group identification etc. Network identifier may be indicative of a group of transmitter units, e.g. a network identifier may comprise a subnet address. The information comprised within a pilot package may enable the hearing device to receive a subsequent such as the following or next audio block from the transmitter unit transmitting the audio stream in question by configuring the hearing device in accordance with the information.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

LIST OF REFERENCES

2, 2' hearing device
4 receiver/loudspeaker
6 processing unit
8 antenna
10 wireless receiver unit
12 microphone
14 converted audio signal
50 first position for a user of a hearing device
50' second position for a user of a hearing device
51 first transmitter unit
52 second transmitter unit
53 third transmitter unit
54 fourth transmitter unit
55 fifth transmitter unit
100 electromagnetic signal
101, 101', 101" first audio block ($A_1$)
102, 102', 102" first primary pilot package ($P_{1,1}$)
103, 103', 103" first secondary pilot package ($P_{1,2}$)
104 first audio frame
106 first primary time offset ($\Delta t_{1,1}$)
108 first secondary time offset ($\Delta t_{1,2}$)
111, 111', 111" second audio block ($A_2$)
112, 112', 112" second primary pilot package ($P_{2,1}$)
113, 113', 113" second secondary pilot package ($P_{2,2}$)
114 second audio frame
116 second primary time offset ($\Delta t_{2,1}$)
118 second secondary time offset ($\Delta t_{2,2}$)
121 third audio block ($A_3$)
122 third primary pilot package ($P_{3,1}$)
123 third secondary pilot package ($P_{3,2}$)
124 third audio frame
126 third primary time offset ($\Delta t_{3,1}$)
128 third secondary time offset ($\Delta t_{3,2}$)
212, 212' reception of audio blocks
214, 214' search and receive pilot packages
200, 200', 200", 200'" audio block
202 primary audio package
204 secondary audio package
206 first primary audio package
208 second primary audio package
210 first secondary audio package
213 second secondary audio package
215 first tertiary audio package
216 second tertiary audio package
400, 400' a method for operating a hearing device
401 receiving audio stream from selected transmitter unit
402 evaluating first parameter
404 determining if search criterion is fulfilled
406 searching for pilot packages
408 evaluating pilot packages
410 determining if switch criterion is fulfilled
412 selecting new transmitter unit
414 determining and selecting optimum transmitter unit

The invention claimed is:

1. A method for receiving wireless audio streams in a hearing device, the method comprising:

receiving audio packages of a primary audio stream from a primary transmitter unit having a primary transmitter unit address, at least one of the audio packages comprising a finite part of audible information in the primary audio stream;

evaluating a first parameter of the primary audio stream; and if the first parameter fulfills a search criterion:

searching for pilot packages from respective available transmitter units, wherein at least one of the pilot packages (1) comprises information regarding a subsequent audio package of the primary audio stream, and (2) is different from the at least one of the audio packages;

determining an optimum transmitter unit based on one or more pilot package parameters of the pilot packages from the available transmitter units; and receiving additional audio packages of the primary audio stream from the optimum transmitter unit;

wherein the act of evaluating the first parameter, the act of searching, and the act of determining the optimum transmitter unit are performed by the hearing device that is configured for worn by a user;

wherein one of the pilot packages corresponding with the optimum transmitter unit includes information for enabling the hearing device to receive the additional audio packages of the primary audio stream from the optimum transmitter unit.

2. The method according to claim 1, wherein the act of determining the optimum transmitter unit comprises:

evaluating at least one of the one or more of the pilot packages from the available transmitter units; and if the at least one of the one or more pilot package parameters fulfills a switch criterion, determining a secondary transmitter unit from the available transmitter units as the optimum transmitter unit.

3. The method according to claim 2, wherein the primary transmitter unit is selected as the optimum transmitter unit if the at least one of the one or more pilot package parameters does not fulfill the switch criterion.

4. The method according to claim 2, wherein the switch criterion is fulfilled if the pilot package parameter of one of the available transmitter units is larger than a pilot package parameter of the primary transmitter unit.

5. The method according to claim 1, wherein the act of determining the optimum transmitter unit comprises:

evaluating at least one of the one or more pilot package parameters from the available transmitter units; and selecting the optimum transmitter unit based on the act of evaluating the at least one of the one or more pilot package parameters.

6. The method according to claim 1, wherein at least one of the one or more pilot packages comprises a transmitter unit address of one of the transmitter units, a time offset, and a channel identifier of a following audio package, and wherein the additional audio packages of the primary audio stream from the optimum transmitter unit is received based on the time offset.

7. The method according to claim 1, wherein at least one of the one or more pilot packages comprises an audio stream identifier, and wherein the act of determining the optimum transmitter unit is based on the audio stream identifier.

8. The method according to claim 1, wherein the first parameter is a parameter indicative of signal strength of the primary audio stream.

9. The method according to claim 1, wherein one of the one or more pilot package parameters is indicative of a pilot package signal strength.

10. The method according to claim 1, wherein the search criterion is fulfilled if the first parameter is below or above a search threshold value.

11. The method according to claim 1, wherein the act of searching for the pilot packages is performed in time intervals in which audio packages from the primary transmitter unit is not being received.

12. The method according to claim 1, wherein the act of searching for the pilot packages comprises receiving data on one or more dedicated pilot channels.

13. The method according to claim 1, wherein the optimum transmitter unit is determined based on best available signal strength.

14. The method of claim 1, wherein the hearing device is configured for worn at a head of the user.

15. The method of claim 14, wherein the hearing device is configured for worn at an ear of the user.

16. The method of claim 1, wherein at least two of the available transmitter units are stationary within a building.

17. The method of claim 1, wherein the information in the one of the pilot packages is for configuring the hearing device.

18. The method of claim 1, wherein at least one of the additional audio packages of the primary audio stream from the optimum transmitter includes a corresponding one of the pilot packages.

19. The method of claim 1, wherein the method is performed by the hearing device, and wherein the hearing device comprises a hearing aid configured to compensate for a hearing loss of the user.

20. The method of claim 1, wherein the at least one of the pilot packages comprises timing information regarding the subsequent audio package.

21. A hearing device comprising:

an antenna;

a processing unit coupled to the antenna;

a receiver coupled to an output of the processing unit for conversion of an output signal into an output audio signal;

wherein the processing unit is configured to:

receive audio packages of a primary audio stream transmitted wirelessly from a primary transmitter unit, the primary transmitter unit having a primary transmitter unit address, at least one of the audio packages comprising a finite part of audible information in the primary audio stream; and evaluate a first parameter of the primary audio stream;

wherein, if the first parameter fulfills a search criterion, the processing unit is configured to:

search for pilot packages transmitted wirelessly from available transmitter units, wherein at least one of the pilot packages (1) comprises information regarding a subsequent audio package of the primary audio stream, and (2) is different from the at least one of the audio packages;

determine an optimum transmitter unit based on one or more pilot package parameters of the pilot packages from the available transmitter units; and receive additional audio packages of the primary audio stream from the optimum transmitter unit;

wherein the hearing device is configured for worn by a user;

wherein one of the pilot packages corresponding with the optimum transmitter unit includes information for enabling the hearing device to receive the additional audio packages of the primary audio stream from the optimum transmitter unit.

22. The hearing device according to claim 21, further comprising a microphone for conversion of an acoustic audio signal into an input audio signal.

23. The hearing device according to claim 21, wherein the processing unit is configured to compensate for hearing loss or hearing disability of a user of the hearing device.

24. The hearing device of claim 21, wherein the hearing device is configured for worn at a head of the user.

25. The hearing device of claim 24, wherein the hearing device is configured for worn at an ear of the user.

26. The hearing device of claim 21, wherein at least two of the available transmitter units are stationary within a building.

27. The hearing device of claim 21, wherein the information in the one of the pilot packages is for configuring the hearing device.

28. The hearing device of claim 21, wherein at least one of the additional audio packages of the primary audio stream from the optimum transmitter includes a corresponding one of the pilot packages.

29. The hearing device of claim 21, wherein the hearing device comprises a hearing aid configured to compensate for a hearing loss of the user.

30. The hearing device of claim 21, wherein the at least one of the pilot packages comprises timing information regarding the subsequent audio package.

* * * * *